US006463607B2

(12) United States Patent
Hartmann

(10) Patent No.: US 6,463,607 B2
(45) Date of Patent: Oct. 15, 2002

(54) MATTRESS SUPPORT

(76) Inventor: Siegbert Hartmann, Neuer Kamp 71, D-32584 Löhne (DE)

( * ) Notice: Subject to any disclaimer, the term of this patent is extended or adjusted under 35 U.S.C. 154(b) by 0 days.

(21) Appl. No.: 09/882,732

(22) Filed: Jun. 15, 2001

(65) Prior Publication Data

US 2002/0002743 A1 Jan. 10, 2002

(30) Foreign Application Priority Data

Jun. 15, 2000 (DE) ..... 200 10 400 U

(51) Int. Cl.[7] ..... A47B 7/02
(52) U.S. Cl. ..... 5/617; 5/612; 5/634
(58) Field of Search ..... 5/612, 613, 617, 5/633, 634

(56) References Cited

U.S. PATENT DOCUMENTS

| | | | | | |
|---|---|---|---|---|---|
| 828,720 | A | * | 8/1906 | Deuerling | 5/617 |
| 942,354 | A | * | 12/1909 | Ryan | 5/617 |
| 1,818,598 | A | * | 8/1931 | Berry | 5/634 |
| 2,108,913 | A | * | 2/1938 | Bawer | 5/617 |
| 2,387,357 | A | * | 10/1945 | Rogerson | 5/617 |
| 4,251,891 | A | * | 2/1981 | Degen | 5/617 |
| 5,774,914 | A | * | 7/1998 | Johnson et al. | 5/617 |
| 5,937,459 | A | * | 8/1999 | Binaghi et al. | 5/634 |
| 6,295,666 | B1 | * | 10/2001 | Takaura | 5/617 |

FOREIGN PATENT DOCUMENTS

| | | | |
|---|---|---|---|
| DE | 2749152 | * | 8/1978 |
| DE | 2951039 | * | 3/1981 |
| DE | 94 10 304.6 | | 9/1994 |

* cited by examiner

*Primary Examiner*—Heather Shackelford
*Assistant Examiner*—Frederick L. Lagman
(74) *Attorney, Agent, or Firm*—Laurence A. Greenberg; Werner H. Stemer; Ralph E. Locher

(57) ABSTRACT

A mattress support, in particular a bed lath grid with a neck support that can be raised with respect to an adjustable backrest has an adjustment mechanism that can be produced easily and economically and that ensures a direct support on the backrest. This is achieved with an adjustment mechanism which has an adjustment lever that is pivotally positioned on a rotational axis. The adjustment lever has a guidance arc that is guided in a restricted guidance fixed on a longitudinal or a transverse beam and a lever arm which is supported on the neck support, so that the adjustment lever can be pivoted around the rotational axis by guiding the guidance arc in the restricted guidance when raising the backrest, and so that the neck support, which moves together with the backrest through the use of the lever arm, can be raised.

11 Claims, 1 Drawing Sheet

MATTRESS SUPPORT

BACKGROUND OF THE INVENTION

Field of the Invention

The invention relates to a mattress support, in particular a bed lath grid having longitudinal beams and transverse beams, a backrest with side beams and transverse beams hinged thereto with hinges, a neck support with side beams and transverse beams, and an adjustment mechanism. The neck support is hingedly connected to the backrest.

German Utility Model No. G 94 10 304 U1 discloses a lath grid having a backrest, which is adjustable through the use of an electric motor, and a neck support. The adjusting motion is generated with an erecting lever, which is pivotally positioned on a longitudinal beam and whose free end engages with a guidance beneath the neck support so that, when the adjusting motion starts from a horizontal position of the backrest and the neck support, initially the neck support is raised and only then the backrest is pivoted as well.

This conventional adjustable lath grid is disadvantageous because its mechanism is very massive and heavy due to its strong lever forces and thus requires a lot of space and its embodiment is economically disadvantageous. In the erected state of the backrest and the neck support, due to the unfavorably great lengths of the levers, very strong forces are created in the hinges so that this device provides only a very unstable construction which strongly contorts when it is loaded on its sides, away from the center.

SUMMARY OF THE INVENTION

It is accordingly an object of the invention to provide a mattress support, in particular a bed lath grid which overcomes the above-mentioned disadvantages of the heretofore-known devices of this general type and which has a neck support that can be raised with respect to an adjustable back rest, which has an adjustment mechanism that can be produced easily and economically and which allows a direct support on the back rest.

With the foregoing and other objects in view there is provided, in accordance with the invention, a mattress support, in particular a bed lath grid, including:

longitudinal support beams;

transverse support beams;

a back rest having back rest side beams, back rest transverse beams, and back rest hinges for hingedly connecting the back rest to at least one of the longitudinal and transverse support beams;

a neck support having neck support side beams, neck support transverse beams, and neck support hinges for hingedly connecting the neck support to the back rest;

an adjustment mechanism having an adjustment lever with a guidance arc and a lever arm;

the back rest having a first back rest side and a second back rest side opposite the first back rest side, the back rest hinges being provided on the first back rest side, the adjustment lever defining a rotational axis and being pivotably connected to the back rest at the second back rest side for rotating about the rotational axis;

the neck support having a first neck support side and a second neck support side, the neck support hinges being provided on the first neck support side, the lever arm supporting the neck support at the second neck support side; and a restricted guidance attached to one of the longitudinal and transverse support beams for guiding the guidance arc, such that, when the backrest is raised, the adjustment lever pivots about the rotational axis and the lever arm raises the neck support.

According to another feature of the invention, an axle extends along the rotational axis. The axle is disposed on one of the back rest transverse beams. The restricted guidance is provided on one of the transverse support beams, and the neck support includes a bearing support provided on one of the neck support transverse beams at the second neck support side such that the lever arm bears against the bearing support.

According to yet another feature of the invention, the longitudinal support beams and the transverse support beams form a bed lath grid, and a further adjustment mechanism is provided on the bed lath grid.

According to a further feature of the invention, a base plate is connected to one of the longitudinal and transverse support beams, and the restricted guidance has two bolts provided on the base plate, the two bolts are spaced from one another such that the guidance arc is guided between the two bolts.

According to yet a further feature of the invention, the neck support includes a bearing support provided on one of the neck support transverse beams at the second neck support side, the bearing support has a planar gliding and support surface, and the lever arm has a support surface at an end thereof for supporting the planar gliding and support surface.

According to another feature of the invention, the neck support has a given weight, and the lever arm has a planar support surface at an end thereof, the lever arm stands in a vertical position when the neck support is in a raised position, the planar support surface is positioned perpendicular to a longitudinal axis of the lever arm and it vertically above the rotational axis such that the adjustment mechanism is in a locked state in order to prevent a reverse pivoting of the adjustment lever by the given weight of the neck support and a weight of a mattress lying on the neck support.

According to yet another feature of the invention, a lateral stop is provided on the adjustment mechanism for stopping the adjustment lever.

According to another feature of the invention, a releasable catching device is provided on the adjustment mechanism, the releasable catching device holds the adjustment lever in place when the neck support is in a raised position.

According to a further feature of the invention, a stop is provided for stopping the adjustment lever when the adjustment lever is in a vertical position, and a spring acts on the adjustment lever close to the rotational axis, the spring holds the adjustment lever in the vertical position against the stop when the neck support is in a raised position and the guidance arc is disposed outside the restricted guidance such that the guidance arc is reinsertable in the restricted guidance when the back rest is lowered.

According to another feature of the invention,the lever arm includes an extension device.

According to the invention, the adjustment mechanism is provided with an adjustment lever which is pivotally positioned on a rotational axis provided on the side opposite to the hinge of the back rest and which is provided with a guidance arc, guided in a restricted guidance fixed on the longitudinal or transverse beam, and an opposite lever arm, which is supported on the neck support on the side opposite of its hinge, so that the adjustment lever is pivoted around the rotational axis by the restricted guidance of the guidance arc when the back rest is raised and the neck support is raised by the lever arm immediately at the beginning of the adjustment process of the back rest and moves correspondingly up to its maximum deflection, and then, with the neck support in the erected position, the back rest alone is being further pivoted.

Therefore, in the erected or raised state the neck support is supported directly on the transverse beam of the back rest through the use of the lever and the rotational axis so that no torque or bending moments are transferred into the backrest via the neck support.

Furthermore, it is advantageous that this adjustment mechanism of the neck support is entirely separate from the backrest so that both adjustment systems each can be embodied in an optimized fashion. Since no fixed connection exists between the adjustment mechanisms, the constructive requirement is facilitated as well, so that possible motion processes impeding each other need not to be considered.

Furthermore, it is advantageous that the adjustment speed and the height of the adjustment can be selected simply by the geometry of the levers. Particularly advantageous is an embodiment in which the lever is embodied such that it is variable in its length so that the pivoting angle of the neck support can be optionally adjusted.

According to a particularly preferred embodiment of the invention the rotational axis is positioned on the transverse beam of the backrest, the restricted guidance on the transverse beam of the bed lath grid, and a bearing support for the lever on the transverse beam of the neck support. However, such a bearing support is not necessarily required since the lever can also be supported directly on the transverse beam. With such a configuration the adjustment lever can be positioned as far a distance from the hinge of the neck support as possible, so that an essentially momentum-free support of the neck support is possible. However, a positioning of the adjustment lever together with the rotational axis on the side beam of the backrest is also conceivable, with or without an additional bearing, with the adjustment mechanisms according to the invention being required in such an embodiment to be positioned on both inner sides of the side beams of the backrest.

Such a double configuration of two adjustment mechanisms to the exterior sides of the transverse beams of the backrest offers a further increased stability of the support of the neck support for the described adjustment mechanism as well.

The adjustment lever is provided with a lever and a guidance arc and the rotational axis positioned therebetween with the lever arm lying close underneath the neck support and the backrest at the lowered state, and the neck support pivots upwards around its hinge when the adjustment lever is rotated or pivoted. Here, the pivoting angle is selected by simply varying the length of the lever. The end of the lever slides either directly underneath the transverse beam of the neck support, preferably however underneath the bearing support embodied in an optimized fashion, with the lever arm resting on a lateral stop and with its now horizontal support area on the bearing support after a rotation of approximately 90° and the contact area is positioned vertically above the rotational axis so that no restoring momentum is transferred into the adjustment lever when the neck support is loaded, but a stable support of the neck support is ensured.

The guidance arc of the adjustment lever is guided in a restricted guidance, which preferably is made of two simple bolts with the guidance arc being guided therebetween, the length and shape of the guidance being selected such that the neck support is immediately pivoted to its maximum deflection when the back rest is erected and subsequently the guidance arc exits the restricted guidance into which it is reinserted when the back rest is lowered.

In order to prevent an undesired pivoting from the supported state, e.g., when the neck support is erected by a person, the adjustment lever is preferably provided on the rotational axis with a spring which is supported on the adjustment lever and which holds the lever arm of the adjustment lever in an approximately vertical position at an unloaded state. In order to secure the guidance and to limit the motion of the adjustment lever, additionally a quarter-circular guidance can be provided.

Furthermore, an embodiment with a lateral mechanical stop or even a releasable catch for the adjustment lever is advantageous so that it cannot pivot laterally back out of its approximately vertical position when an unintended lateral load is applied.

Other features which are considered as characteristic for the invention are set forth in the appended claims.

Although the invention is illustrated and described herein as embodied in the mattress support, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
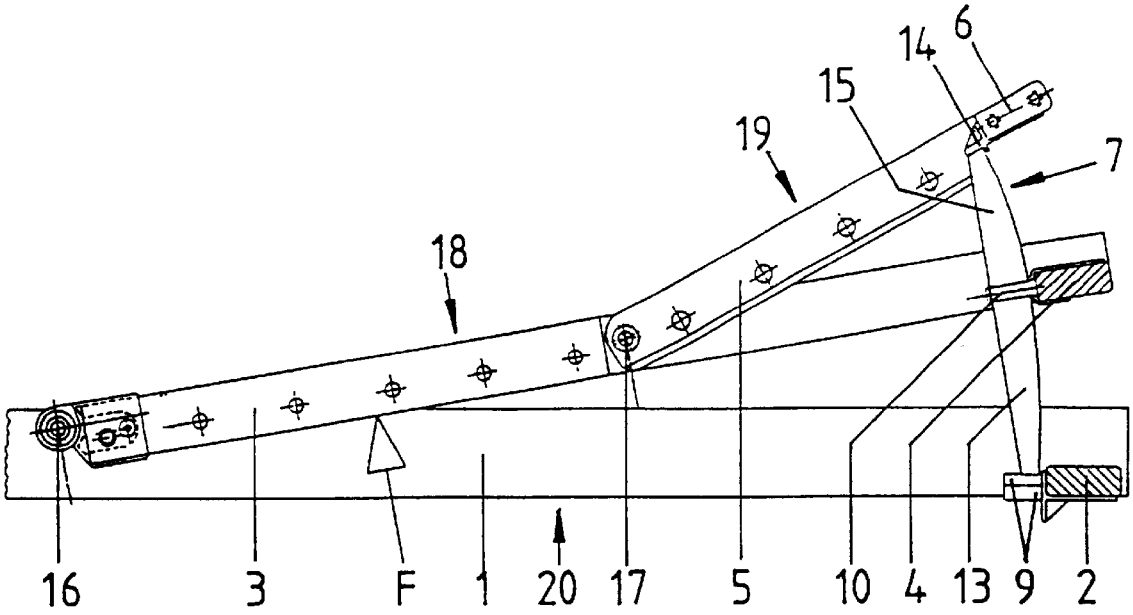
FIG. 1 is a partial, diagrammatic sectional view of a bed lath grid, wherein the backrest is in a partially raised position and the neck support is in a fully raised position.

Referring now to the figures of the drawings in detail and first, particularly, to FIG. 1 thereof, there is shown a mattress support, which according to the described exemplary embodiments includes a bed lath grid 20. However, the mattress support may also be made from bottom parts or floor parts that are pivotable against one another or from a construction of single spring elements. The bed lath grid 20 is formed essentially of a longitudinal beam 1 and a transverse beam 2 with a back rest 18 being hinged through the use of a hinge 16 wherein the backrest includes a side beam 3 and a transverse beam 4 with spring beams therebetween, which are not shown in the drawings. A neck support is pivotally mounted through the use of a hinge 17 which has side beams 5 and a transverse beam 6, here again being provided with spring beams, which are provided between the transverse beams 6 but not shown in the drawings.

From the transverse beam 4 of the back rest 18 a rotational axis 10 extends inward on which an adjustment lever 7 is pivotally positioned which has a guidance arc 13 reaching downward into a restricted guidance 8 which is mounted on the transverse beam 2 of the bed lath grid 20 and which essentially is provided with two bolts 9 and the guidance arc 13 of the adjustment lever 7 reaching therebetween, at least in the lowered and a partially erected position of the backrest 18. A lever arm 15 extends into the opposite direction of the guidance arc 13 and has a support area or support surface 12 on its end, which extends at a right angle in relation to an imaginary longitudinal axis of the lever arm 15 through the pivoting axis 10, and which is supported on the surface of the bearing 14 in the erected state of the neck support 19, with the support area 12 being vertically above the pivoting axis (axle) 10 so that the transverse beam 6 of the neck support 19 is supported directly on the transverse beam 4 of the backrest 18 through the use of the lever arm 15.

Figure 2:
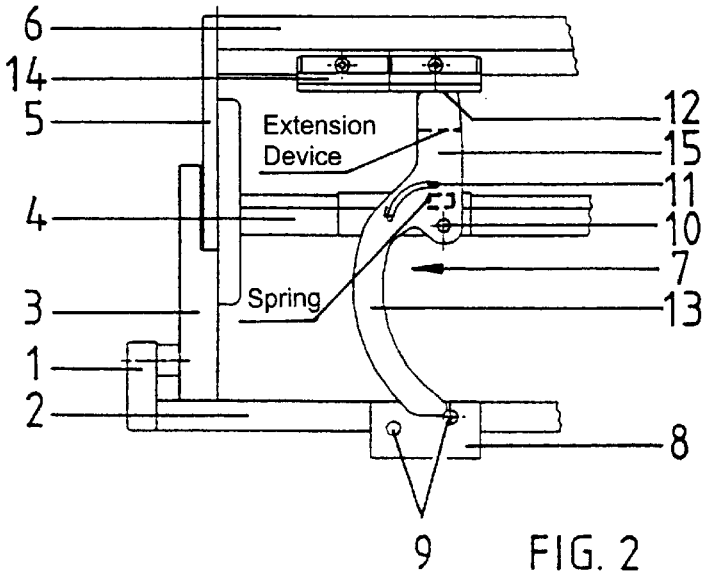
FIG. 2 is a partial side view of the bed lath grid of FIG. 1.
Figure 3:
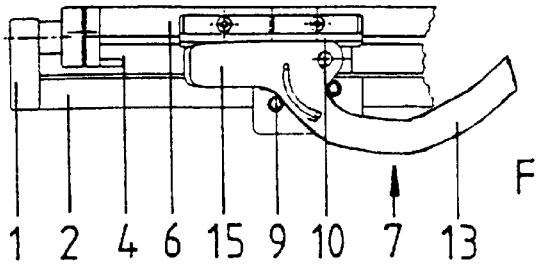
FIG. 3 is a partial side view of the bed lath grid of FIG. 2 in a completely lowered state.

The adjustment lever 7 is provided with a quarter circular recess 11 as a motion limit around the pivoting axis 10. Furthermore, a spring, which is schematically indicated as a dashed-line box in FIG. 2, is mounted on the pivoting axis 10.

The spring keeps the adjustment lever 7, when in an unloaded state, in an approximately vertical position when the backrest is in a raised state so that, on the one hand, when the neck support 19 is loaded again, the direct support is again ensured and, on the other hand, when the backrest 18 is lowered the proper insertion of the guidance arc 13 between the bolts 9 of the restricted guidance 8 is ensured.

When erecting the back rest 18 of the bed lath grid 20 the adjustment lever 7 of the bolts 9 of the restricted guidance 8 is pivoted around the pivoting axis 10 which causes the lever arm 15 of the adjustment lever 7 to raise the transverse beam 6 and the neck support 19 until the adjustment lever 7 has reached an approximately vertical position, in which the guidance arc 13 of the adjustment lever 7 leaves the influence of the restricted guidance 8. The adjustment height and the adjustment speed can be freely predetermined via the geometry of the lever. An embodiment of the adjustment lever 7 with an extension device of the lever arm 15 allows a variation of the adjustment height of the neck support 19. The extension device is only schematically indicated with a dashed line in FIG. 2.

I claim:

1. A mattress support, comprising:

longitudinal support beams;

transverse support beams;

a back rest having back rest side beams, back rest transverse beams, and back rest hinges for hingedly connecting said back rest to at least one of said longitudinal and transverse support beams;

a neck support having neck support side beams, neck support transverse beams, and neck support hinges for hingedly connecting said neck support to said back rest;

an adjustment mechanism having an adjustment lever with a guidance arc and a lever arm;

said back rest having a first back rest side and a second back rest side opposite said first back rest side, said back rest hinges being provided on said first back rest side, said adjustment lever defining a rotational axis and being pivotably connected to said back rest at said second back rest side for rotating about the rotational axis;

said neck support having a first neck support side and a second neck support side, said neck support hinges being provided on said first neck support side, said lever arm supporting said neck support at said second neck support side; and a restricted guidance attached to one of said longitudinal and transverse support beams for guiding said guidance arc, such that, when said backrest is raised, said adjustment lever pivots about the rotational axis and said lever arm raises said neck support.

2. The mattress support according to claim 1, wherein said longitudinal support beams, said transverse support beams, said back rest and said neck support together form a bed lath grid.

3. The mattress support according to claim 1, including:

an axle extending along the rotational axis and being disposed on one of said back rest transverse beams;

said restricted guidance being provided on one of said transverse support beams; and said neck support including a bearing support provided on one of said neck support transverse beams at said second neck support side, said lever arm bearing against said bearing support.

4. The mattress support according to claim 1, wherein said longitudinal support beams and said transverse support beams form a bed lath grid, and a further adjustment mechanism is provided on said bed lath grid.

5. The mattress support according to claim 1, including:

a base plate connected to one of said longitudinal and transverse support beams; and said restricted guidance having two bolts provided on said base plate, said two bolts being spaced from one another such that said guidance arc is guided between said two bolts.

6. The mattress support according to claim 1, wherein:

said neck support includes a bearing support provided on one of said neck support transverse beams at said second neck support side, said bearing support has a planar gliding and support surface; and said lever arm has a support surface at an end thereof for supporting said planar gliding and support surface.

7. The mattress support according to claim 1, wherein:

said neck support has a given weight; and said lever arm has a planar support surface at an end thereof, said lever arm stands in a vertical position when said neck support is in a raised position, said planar support surface is positioned perpendicular to a longitudinal axis of said lever arm and vertically above the rotational axis such that said adjustment mechanism is in a locked state in order to prevent a reverse pivoting of said adjustment lever by the given weight of said neck support and a weight of a mattress lying on said neck support.

8. The mattress support according to claim 1, including a lateral stop provided on said adjustment mechanism for stopping said adjustment lever.

9. The mattress support according to claim 1, including a releasable catching device provided on said adjustment mechanism, said releasable catching device holding said adjustment lever in place when said neck support is in a raised position.

10. The mattress support according to claim 1, including:

a stop for stopping said adjustment lever when said adjustment lever is in a vertical position; and a spring acting on said adjustment lever in a vicinity of the rotational axis, said spring holding said adjustment lever in the vertical position against said stop when said neck support is in a raised position and said guidance arc is disposed outside said restricted guidance such that said guidance arc is reinsertable in said restricted guidance when said back rest is lowered.

11. The mattress support according to claim 1, wherein said lever arm includes an extension device.

* * * * *